US005727283A

United States Patent [19]

Webster

[11] Patent Number: 5,727,283

[45] Date of Patent: Mar. 17, 1998

[54] COLLECTION APPARATUS

[75] Inventor: Craig Duncan Webster, Newcastle-upon Tyne, United Kingdom

[73] Assignee: Black & Decker Inc., Newark, Del.

[21] Appl. No.: 447,461

[22] Filed: May 23, 1995

[30] Foreign Application Priority Data

May 28, 1994 [GB] United Kingdom ..... 9410772

[51] Int. Cl.[6] ..... A47L 5/18

[52] U.S. Cl. ..... 15/409; 15/330; 15/344

[58] Field of Search ..... 15/330, 409

[56] References Cited

U.S. PATENT DOCUMENTS

| | | | |
|---|---|---|---|
| 2,026,291 | 12/1935 | Tirimacco | 15/409 X |
| 2,293,115 | 8/1942 | Child | 15/409 X |
| 3,704,482 | 12/1972 | Brannon | 15/409 |
| 4,018,483 | 4/1977 | Smith . | |
| 4,290,165 | 9/1981 | Hiramatsu et al. | 15/409 X |
| 5,450,649 | 9/1995 | Turnbull | 15/330 |
| 5,477,585 | 12/1995 | Hentzschell et al. | 15/409 X |

FOREIGN PATENT DOCUMENTS

| | | |
|---|---|---|
| 0501675 | 9/1992 | European Pat. Off. . |
| 0400532 | 7/1908 | France . |
| 2405331 | 5/1979 | France . |
| 3912885 | 10/1990 | Germany . |
| 0587272 | 3/1994 | United Kingdom . |

*Primary Examiner*—Chris K. Moore

*Attorney, Agent, or Firm*—Charles E. Yocum; Kerry H. Owens

[57] ABSTRACT

A collection apparatus includes an air outlet, a collection mouth and an apparatus for creating an airstream for discharge at the air outlet. The collection apparatus further includes a cylinder mounted at the air outlet for rotation and a device for directing an airstream tangentially across the surface of said cylinder.

4 Claims, 2 Drawing Sheets

COLLECTION APPARATUS

BACKGROUND OF THE INVENTION

The present invention relates to a collection apparatus, which may be a debris collecting apparatus, such as a garden debris collecting apparatus, in particular of the kind which may be used either in a vacuum mode to suck debris onto the apparatus or in a blowing mode to discharge a stream of air from a nozzle so that debris can be blown into piles, or a suction cleaner, for example a domestic vacuum cleaner.

It is an object of the present invention to provide an improved collection apparatus.

BRIEF SUMMARY OF THE INVENTION

The present invention provides a collection apparatus comprising a) an air outlet b) a collection mouth and c) means for creating an airstream for discharge at the air outlet characterised in that the apparatus further comprises d) a cylinder mounted at the air outlet e) means for directing the discharged air stream substantially tangentially across the surface of the cylinder.

In a preferred embodiment of the apparatus according to the invention, there is further provided means for controlling the speed of rotation of the cylinder, for example a brake, a turbine fitted to the cylinder or a motor.

The collection mouth may be adapted to be connected to a receptacle for debris collected, or to a device for further processing the debris collected, such as a device for comminuting the debris.

The collection apparatus may be of the type which can be used in a vacuum mode to suck debris into the apparatus, or in a blowing mode so that debris can be blown into piles.

In order to use the apparatus selectively in the blowing mode, a switch arrangement can be provided in a manner known per se selectively to direct the airstream away from the cylinder towards the debris to be dislodged. Alternatively, or additionally, the means for controlling the speed of rotation of the cylinder may be a brake or a motor which would have the effect of changing the speed and/or direction of rotation of the cylinder in order to direct the air away from the collection mouth and towards the debris to be dislodged. Alternatively, the collection mouth of the collection apparatus according to the invention may comprise the grass collection mouth of a lawn mower.

BRIEF DESCRIPTION OF THE SEVERAL VIEWS OF THE DRAWINGS

An embodiment of a collection apparatus according to the invention will now be further described with reference to the accompanying drawings, in which.

DETAILED DESCRIPTION

Figure 1:
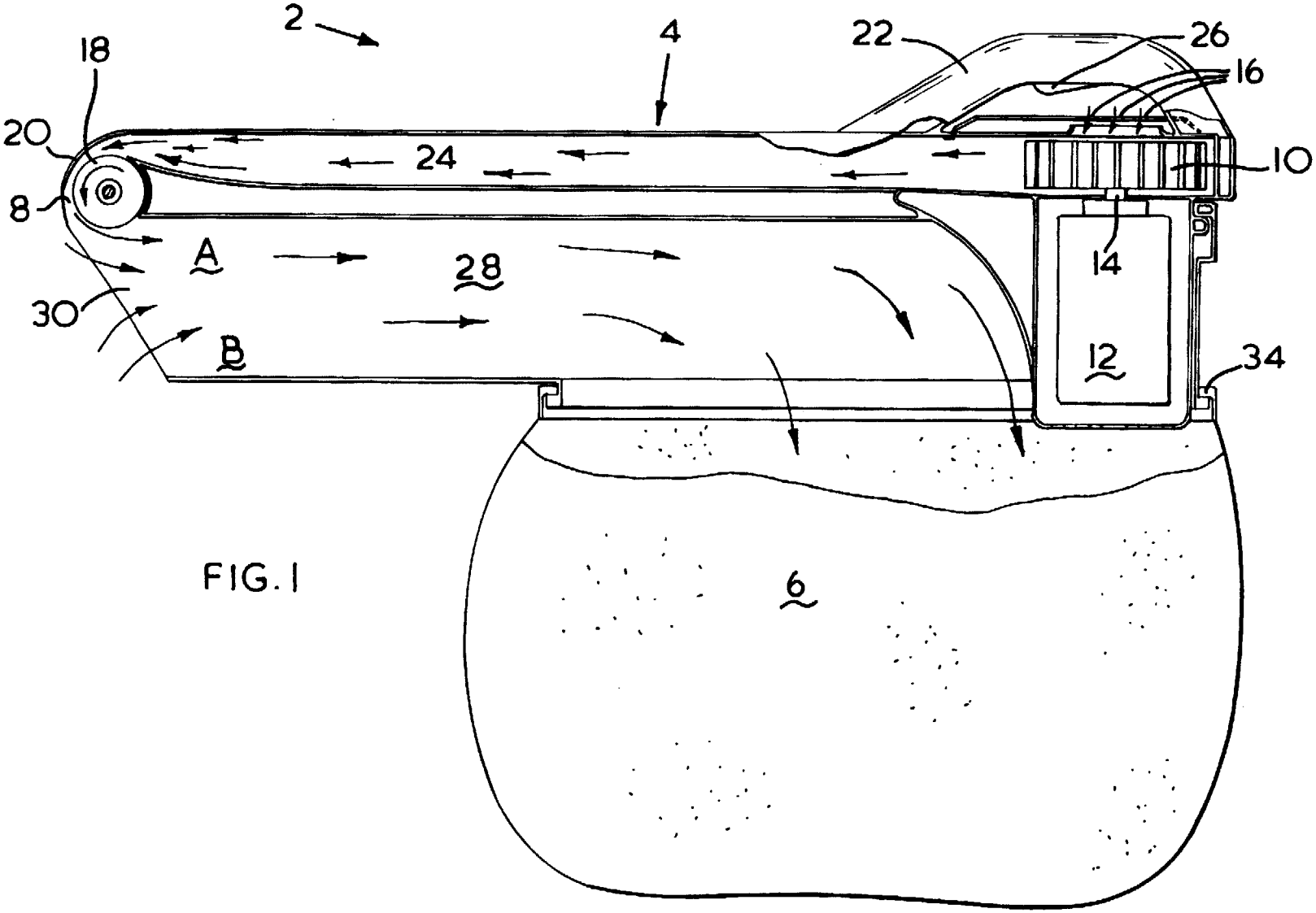
FIG. 1 is a view of a collection apparatus in the form of a blower vacuum.

As can be seen from FIG. 1, a collection unit (2) comprises a housing (4) and a collection bag (6). The housing (4) comprises an air outlet (8) and an impeller (10) for creating an airstream for discharge at the air outlet (8). A motor (12) is located within the housing (4) and the impeller (10) is mounted on an output shaft (14) of the motor (12) adjacent to the air inlet holes (16) provided in the housing (4). A cylinder (18) is mounted for rotation at the air outlet (8) and a control surface (20) is positioned to deflect the airstream discharged at the air outlet (8).

A handle (22) is mounted on the housing (4) at the end of a conduit or first channel (24) remote from the air outlet (8) and an on/off switch (26) Controlling the supply of electrical power to the motor (12) is provided in this handle (22).

The housing (4) further comprises a debris conduit (28), a collection mouth (30) being located at the operating end of the debris conduit or second channel (28), adjacent to the air outlet (8).

A debris container (6) is mounted at the end of the debris conduit (28) remote from the operating end, and communicates with the debris conduit (28) so that debris can be collected at the collection mouth (30, and deposited in the container (6).

The debris container (6) is attached to the housing (4) by clip means (34) and is removable for emptying collected debris.

Figure 2:
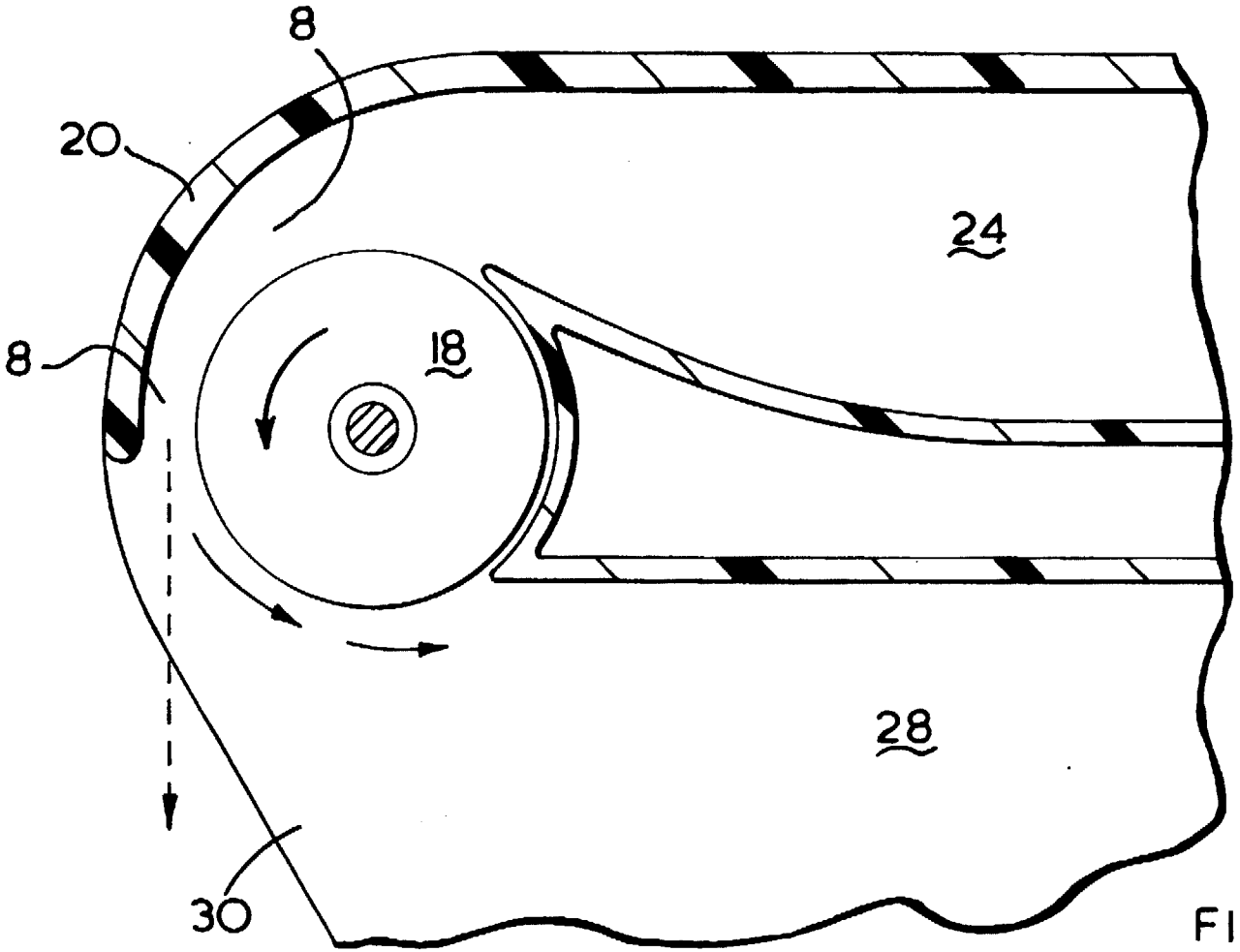
FIG. 2 is an enlarged view of part of the apparatus of FIG. 1, in section.

In operation, as can be seen from FIG. 1 and FIG. 2, an airstream created by the impeller (10) is discharged at the air outlet (8) and is directed by the control surface(20) to a direction substantially tangential to the surface of the cylinder (18). The cylinder (18) is rotated, either by the airstream alone, or by the airstream plus a motor (not shown) and a high speed airstream is thus generated. This high speed airstream (A) carries an entrained airstream (B) which collects debris to be deposited in the container (6).

The surface of the cylinder (18) may be roughened in texture, or profiled or provided with ribs.

I claim:

1. Collection apparatus comprising a) an air outlet;

b) a collection mouth;

c) means for creating an airstream for discharge at the air outlet;

d) a rotatable cylinder mounted at the air outlet and disposed between a first channel and a second channel; and e) means for directing the discharged airstream substantially tangentially across a surface of the rotatable cylinder such that the rotatable cylinder rotates in the direction of airstream flow.

2. Collection apparatus according to claim 1, wherein said collection mouth is adapted to be connected to a receptacle for debris collected.

3. Collection apparatus according to claim 1, which comprises a suction cleaner, in particular for domestic use.

4. Collection apparatus according to claim 1, wherein the means for directing the discharged airstream is a stationary control surface.

* * * * *